US008250966B2

(12) United States Patent
Yoshida et al.

(10) Patent No.: US 8,250,966 B2
(45) Date of Patent: Aug. 28, 2012

(54) METHOD OF MANUFACTURING BELLOWS

(75) Inventors: Tsutomu Yoshida, Machida (JP); Tadahiro Ohmi, Sendai (JP); Yasuyuki Shirai, Sendai (JP); Masafumi Kitano, Sendai (JP)

(73) Assignees: Nippon Valqua Industries, Ltd., Tokyo (JP); Tohoku University, Sendai-shi (JP)

( * ) Notice: Subject to any disclaimer, the term of this patent is extended or adjusted under 35 U.S.C. 154(b) by 937 days.

(21) Appl. No.: 12/327,261

(22) Filed: Dec. 3, 2008

(65) Prior Publication Data

US 2009/0139397 A1 Jun. 4, 2009

(30) Foreign Application Priority Data

Dec. 4, 2007 (JP) ..... 2007-313597

(51) Int. Cl.
*F16J 3/04* (2006.01)

(52) U.S. Cl. ..... 92/47

(58) Field of Classification Search ..... 92/34, 35, 92/47; 29/454

See application file for complete search history.

(56) References Cited

U.S. PATENT DOCUMENTS 4,798,632 A * 1/1989 Yonezawa et al. ..... 148/675
5,827,377 A * 10/1998 Crum et al. ..... 148/442
2004/0156737 A1* 8/2004 Rakowski ..... 420/53

FOREIGN PATENT DOCUMENTS

JP 2001200346 A 7/2001

* cited by examiner

*Primary Examiner* — Michael Leslie
(74) *Attorney, Agent, or Firm* — The Webb Law Firm

(57) ABSTRACT

Method for producing at low cost bellows which show high durability even when used in a quite reactive atmosphere. The method for manufacturing bellows includes the steps of: I: forming an untreated bellows from a flat base plate, the base plate including 15 to 30 wt % of Cr, 5 to 40 wt % of Ni, 0.9 to 6 wt % of Al, less than 1 wt % of Mo, less than 0.1 wt % of Mn, less than 0.1 wt % of C, less than 0.1 wt % of S, less than 0.1 wt % of P and a balance of Fe and an unavoidable impurity (relative to 100 wt % of the base plate); and II: heating the untreated bellows at a temperature of 750 to 895° C. in an atmosphere which contains water and hydrogen and in which the volume ratio of hydrogen to water ($H_2/H_2O$) is in the range of $2\times10^3$ to $1\times10^{12}$, thereby forming an $Al_2O_3$ passivation film on a surface of the untreated bellows.

17 Claims, 6 Drawing Sheets

METHOD OF MANUFACTURING BELLOWS

FIELD OF THE INVENTION

The present invention relates to a method of manufacturing surface-treated bellows, and in particular to a method of manufacturing bellows having excellent corrosion resistance and plasma resistance.

BACKGROUND OF THE INVENTION

Bellows used in semiconductor-manufacturing apparatus are exposed to corrosive gases and active gases such as plasma, ozone and oxygen radicals. Stainless steels such as SUS 316 L and SUS 304 L that are generally employed as base materials for bellows do not have resistance to corrosive gases and active gases. They are therefore usually subjected to surface-treatments to achieve resistance to corrosive gases and active gases. The surface treatments include $Cr_2O_3$-passivation treatment providing excellent resistance to corrosive gases such as HCl, and fluoride-passivation treatment giving high corrosion resistance and plasma resistance.

However, $Cr_2O_3$-passivated bellows or fluoride-passivated bellows are not sufficiently resistant to corrosive gases and active gases. The use of such bellows in semiconductor manufacturing apparatus causes metallic contamination of semiconductor products such as semiconductor wafers.

For example, $Cr_2O_3$-passivated bellows show high corrosion resistance but are poor in plasma resistance. Furthermore, $Cr_2O_3$-passivated bellows cause chromium contamination when exposed to ozone or oxygen radicals, because trivalent chromium ($Cr_2O_3$) contained in the $Cr_2O_3$ passivation films is converted into volatile hexavalent chromium ($CrO_3$).

Fluoride-passivated bellows have excellent corrosion resistance and plasma resistance. However, fluorine has a catalytic action for special material gases such as $SiH_4$ and $PH_3$ used in semiconductor manufacturing, and these material gases are decomposed at relatively low temperatures.

Patent Document 1 discloses $Al_2O_3$-passivated bellows that are obtained by oxidizing untreated bellows made of stainless steels of various chemical compositions, at 900 to 1200° C. in a hydrogen or inert gas atmosphere containing 1 to 10 ppm of water. The bellows are described to show high durability even when used in a highly reactive atmosphere and to be manufactured at low costs.

According to Patent Document 1, however, the chemical compositions of the stainless steels that are base materials for the bellows are broad and are not sufficiently specified, and further, the oxidation entails high temperatures of 900 to 1200° C. and consequently makes the bellows production costs high.

Patent Document 1: JP-A-2001-200346

The present invention has been made to solve the problems in the art.

It is therefore an object of the invention to provide an inexpensive method for producing bellows which show high durability even when used in a quite reactive atmosphere and which have a small catalytic function of facilitating the decomposition of special material gases such as $SiH_4$ and $PH_3$ used in semiconductor manufacturing.

SUMMARY OF THE INVENTION

The present inventors studied diligently to achieve the above object and have completed the present invention.

A method of manufacturing bellows according to the present invention comprises the steps of:

I: forming an untreated bellows from a flat base plate, the base plate comprising 15 to 30 wt % of Cr, 5 to 40 wt % of Ni, 0.9 to 6 wt % of Al, less than 1 wt % of Mo, less than 0.1 wt % of Mn, less than 0.1 wt % of C, less than 0.1 wt % of S, less than 0.1 wt % of P and a balance of Fe and an unavoidable impurity (relative to 100 wt % of the base plate); and II: heating the untreated bellows at a temperature within a range of 750 to 895° C. in an atmosphere which contains water and hydrogen and in which the volume ratio of hydrogen to water ($H_2/H_2O$) is in the range of $2\times10^3$ to $1\times10^{12}$, thereby forming an $Al_2O_3$ passivation film on a surface of the untreated bellows.

Preferably, the atmosphere in the step of II contains water and hydrogen in total at 0.001 to 100% by volume, and an inert gas at 99.999 to 0% by volume.

Preferably, the step I comprises a first step in which at least four annular plate members each having an outer peripheral rim and an inner peripheral rim are punched out from a flat base plate, the base plate comprising 15 to 30 wt % of Cr, 5 to 40 wt % of Ni, 0.9 to 6 wt % of Al, less than 1 wt % of Mo, less than 0.1 wt % of Mn, less than 0.1 wt % of C, less than 0.1 wt % of S, less than 0.1 wt % of P and a balance of Fe and an unavoidable impurity (relative to 100 wt % of the base plate); a second step in which each pair of the annular plate members is stacked and joined together by welding the inner peripheral rims to produce a plurality of welded members; and a third step in which the plurality of the welded members are stacked and joined together by welding the outer peripheral rims to form an untreated bellows.

Preferably, the flat base plate is an electropolished flat base plate.

Preferably, a step of electropolishing surfaces of the annular plate members is performed between the first step and the second step.

Preferably, the $Al_2O_3$ passivation film has a thickness of 20 to 150 nm.

Preferably, the $Al_2O_3$ passivation film contains $Al_2O_3$ at 98 to 100 wt %.

A bellows according to the present invention is obtained by: forming an untreated bellows from a flat base plate, the base plate comprising 15 to 30 wt % of Cr, 5 to 40 wt % of Ni, 0.9 to 6 wt % of Al, less than 1 wt % of Mo, less than 0.1 wt % of Mn, less than 0.1 wt % of C, less than 0.1 wt % of S, less than 0.1 wt % of P and a balance of Fe and an unavoidable impurity (relative to 100 wt % of the base plate); and heating the untreated bellows at a temperature within a range of 750 to 895° C. in an atmosphere which contains water and hydrogen and in which the volume ratio of hydrogen to water ($H_2/H_2O$) is in the range of $2\times10^3$ to $1\times10^{12}$, thereby forming an $Al_2O_3$ passivation film on a surface of the untreated bellows.

Preferably, the atmosphere contains water and hydrogen in total at 0.001 to 100% by volume, and an inert gas at 99.999 to 0% by volume.

Preferably, the $Al_2O_3$ passivation film has a thickness of 20 to 150 nm.

Preferably, the $Al_2O_3$ passivation film contains $Al_2O_3$ at 98 to 100 wt %.

ADVANTAGES OF THE INVENTION

The methods of the invention produce at low costs bellows which show high durability even when used in a very reactive atmosphere and which have a very small catalytic action of facilitating the decomposition of special material gases such as $SiH_4$ and $PH_3$ used in semiconductor manufacturing.

The specific chemical composition of the base plate according to the invention provides high mechanical properties and extended mechanical life such as an increased number of extension/contraction cycles over conventional bellows. The mechanical properties in combination with the durability allow for drastic improvement in bellows life.

PREFERRED EMBODIMENTS OF THE INVENTION

Figure 1:
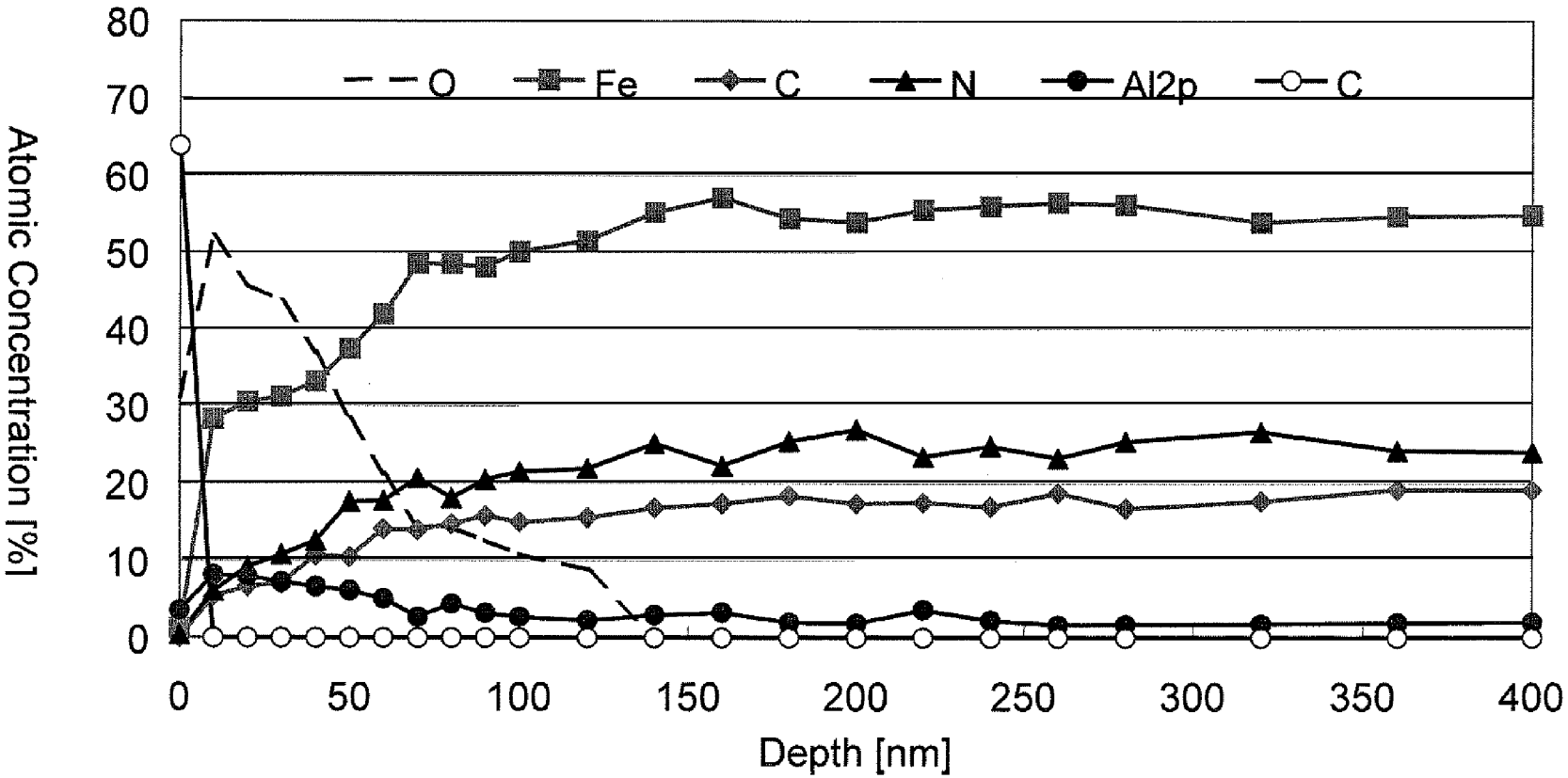
FIG. 1 shows results of XPS measurement of a flat base plate used in Example 1.

The methods of manufacturing bellows according to the present invention will be described hereinbelow.

The method for manufacturing bellows according to the present invention comprises a step I in which an untreated bellows is formed from a flat base plate, the base plate comprising 15 to 30 wt % of Cr, 5 to 40 wt % of Ni, 0.9 to 6 wt % of Al, less than 1 wt % of Mo, less than 0.1 wt % of Mn, less than 0.1 wt % of C, less than 0.1 wt % of S, less than 0.1 wt % of P and a balance of Fe and an unavoidable impurity (relative to 100 wt % of the base plate); and a step II in which the untreated bellows is heated at 750 to 895° C. in an atmosphere which contains water and hydrogen and in which the volume ratio of hydrogen to water ($H_2/H_2O$) is in the range of $2\times10^3$ to $1\times10^{12}$, and thereby an $Al_2O_3$ passivation film is formed on a surface of the untreated bellows.

<Flat Base Plates>

The flat base plates used as base materials for the bellows in the invention contain the following elements (relative to 100 wt % of the flat base plate). Examples of the flat base plates having such a chemical composition according to the invention include Al-containing stainless steel HR31 (austenitic stainless steel manufactured by Sumitomo Metal Industries, Ltd.) and SUS 631. The Al-containing stainless steel HR31 surpasses common materials such as SUS 316 L in mechanical properties such as tensile strength and Young's modulus, and the obtainable bellows achieve improved mechanical life.

The flat base plate used in the invention may be polished beforehand. Preferred polishing methods include electropolishing as described later.

The elements found in the flat base plates of the invention are described below.

(Cr)

The Cr content in the flat base plate is 15 to 30 wt %, and preferably 15 to 20 wt %.

Cr is necessary to ensure corrosion resistance of the obtainable bellows.

If the Cr content exceeds the above range, welding the flat base plates tends to result in precipitation of a Cr-containing intermetallic compound at a welded part. Consequently, hot workability of the flat base plate is lowered and the toughness of the bellows is reduced. If the Cr content is below the above range, the obtainable bellows has lowered corrosion resistance and will develop rust in contact with a neutral aqueous solution such as pure water or in an atmosphere of a clean room in semiconductor manufacturing facility.

(Ni)

The Ni content in the flat base plate is 5 to 40 wt %, and preferably 20 to 30 wt %.

Ni provides improved corrosion resistance of the flat base plate and is effective for the formation of a stable austenite phase in the flat base plate.

If the Ni content exceeds the above range, welding the flat base plates results in precipitation of a Ni—Al intermetallic compound at a welded part. Consequently, hot workability of the flat base plate is lowered and the toughness of the bellows is reduced. If the Ni content is below the above range, it is difficult that the flat base plate maintains the austenite phase.

(Al)

The Al content in the flat base plate is 0.9 to 6 wt %, and preferably 2 to 4 wt %.

In the bellows production process of the invention, Al is necessary so that an $Al_2O_3$ passivation film will be formed on a surface of an untreated bellows by heating the untreated bellows under specific conditions.

If the Al content exceeds the above range, welding the flat base plates results in precipitation of a Ni—Al intermetallic compound at a welded part. Consequently, hot workability of the flat base plate is lowered and the toughness of the bellows is reduced. If the Al content is below the above range, it is difficult to form an $Al_2O_3$ passivation film on a surface of an untreated bellows.

(Mo)

The Mo content in the flat base plate is less than 1 wt %, and preferably less than 0.1 wt %.

Mo is used in the flat base plate as required. Mo increases corrosion resistance of the flat base plate, and therefore it may be contained in the flat base plate when the bellows need higher corrosion resistance. However, using Mo exceeding the above range tends to result in precipitation of a Mo-containing intermetallic compound and the toughness of the flat base plate is lowered.

(Mn)

The Mn content in the flat base plate is less than 0.1 wt %, and preferably less than 0.01 wt %.

Mn improves hot workability of the flat base plate, and therefore a small amount thereof may be used when enhanced hot workability is required. However, using Mn exceeding the above range inhibits the formation of an $Al_2O_3$ passivation film and the corrosion resistance of the bellows is lowered. Further, when the flat base plates are welded, Mn is preferentially concentrated at a surface of a welded part to drastically lower rust resistance and corrosion resistance of the bellows produced. Thus, the Mn content is preferably small.

(C)

The C content in the flat base plate is less than 0.1 wt %, and preferably less than 0.01 wt %.

If the flat base plate contains C exceeding the above range, welding the flat base plates tends to result in formation of Cr carbide at a welded part and the Cr content near the crystal grain boundaries is reduced to drastically lower rust resistance and grain boundary corrosion resistance. Furthermore, the excessive use of C may cause formation of carbide in the step II in which an $Al_2O_3$ passivation film is formed on a surface of an untreated bellows, and the obtainable bellows may have drastically lower rust resistance and grain boundary corrosion resistance.

(S)

The S content in the flat base plate is less than 0.1 wt %, and preferably less than 0.01 wt %.

Sulfur often forms a non-metallic sulfide compound. When such non-metallic sulfide compounds are present in the $Al_2O_3$ passivation film, they work as defects to lower corrosion resistance of the passivation film. The non-metallic compounds are also a factor to lower surface smoothness of the flat base plate and can cause corrosion of the flat base plate. Sulfur can react with an active gas used in a semiconductor manufacturing device and forms a non-metallic compound in the form of fine particles (dust). Such particles can contaminate substrates such as semiconductor wafers. Thus, the S content is preferably small.

(P)

The P content in the flat base plate is less than 0.1 wt %, and preferably less than 0.01 wt %.

The P content exceeding the above range leads to lower weldability of the flat base plates.

(Fe)

The Fe content in the flat base plate is generally 30 to 70 wt %, and preferably 40 to 60 wt %.

(Unavoidable Impurities)

The flat base plate used in the invention generally contains unavoidable impurities, but a less amount thereof is more preferable. The content of unavoidable impurities is generally less than 0.1 wt %, and preferably less than 0.01 wt %.

If unavoidable impurities are present exceeding the above range, it is difficult to form an $Al_2O_3$ passivation film on a surface of an untreated bellows by heating the untreated bellows under specific conditions. Further, welding the flat base plates results in precipitation of an intermetallic compound derived from the unavoidable impurities at a welded part. Consequently, hot workability of the flat base plate is lowered and the toughness of the bellows is reduced.

The unavoidable impurities include Cu and Si.

[Step I]

In the step I, an untreated bellows is formed from the flat base plate having the above chemical composition.

In the step I, untreated bellows may be formed by any general methods without limitation. For example, untreated bellows may be formed by welding or molding. Welding is preferable in view of pressure resistance and extension and contraction properties of the untreated bellows.

<Welding Method>

An embodiment given below illustrates formation of untreated bellows by welding. However, other steps may be performed while still achieving the object of the invention.

In an embodiment of producing untreated bellows by welding, the step I preferably includes a first step in which at least four annular plate members having an outer peripheral rim and an inner peripheral rim are punched out from the flat base plate; a second step in which each pair of the annular plate members is stacked and joined together by welding the inner peripheral rims to produce a plurality of welded members; and a third step in which the plurality of the welded members are stacked and joined together by welding the outer peripheral rims to form an untreated bellows.

Preferably, a step of polishing surfaces of the annular plate members is performed between the first step and the second step.

(First Step)

In the first step, at least four annular plate members having an outer peripheral rim and an inner peripheral rim are punched out by pressing or the like from the flat base plate having the above chemical composition. The flat base plate is preferably pressed such that the annular plate members punched out will have an outer peripheral rim and an inner peripheral rim and waves are formed concentrically on the annular plate members.

The number of the annular plate members punched out in the first step may vary depending on the size of the bellows to be produced, but is at least 4 and is generally from 20 to 200.

(Second Step)

In the second step, each pair of the annular plate members from the first step is stacked with contact between the respective inner peripheral rims and is joined together by welding the inner peripheral rims to produce welded members.

(Third Step)

In the third step, a plurality of the welded members from the second step are stacked and joined together by welding the outer peripheral rims to form an untreated bellows. This step may be performed for example by stacking the plurality of the welded members from the second step and fixing them while their outer peripheral rims contact each other, with a spacer being interposed between the outer peripheral rims of each welded member; and welding the outer peripheral rims to produce an untreated bellows. The untreated bellows formed by welding is then subjected to the step II described later.

<Molding Method>

An embodiment of producing untreated bellows by molding is given below.

In this embodiment, the flat base plate is welded into a cylindrical member. The cylindrical member is placed in a pressing mold having a bellows inner surface, and an inert gas or the like is introduced inside the cylindrical member at high pressure. By pressurizing the inside of the cylindrical member, the side of the cylindrical member is pressed against the inner wall of the pressing mold. As a result, the cylindrical member is shaped to an untreated bellows having a bellows cross section.

The untreated bellows formed by molding is then subjected to the step II described later.

<Polishing Step>

In the bellows production process of the invention, it is structurally difficult to polish the untreated bellows or the final bellows. Accordingly, it is preferable that polishing is performed before the untreated bellows is produced. For example, the flat base plate may be polished before use, or the annular plate members may be polished between the first step and the second step.

The flat base plates or the annular plate members that are not polished have foreign matters or great unevenness formed by crystal grains on the surface. If an $Al_2O_3$ passivation film is formed on such a rough surface, the passivation film may be nonuniform in thickness and have poor corrosion resistance. Further, because water or the like is stored or adsorbed between crystal grains on the surface of the base plate, the passivation film may not have sufficient degassing properties. Furthermore, the thickness of the $Al_2O_3$ passivation film on the untreated bellows is preferably not more than 150 nm as described later, and it is therefore preferable to smooth the surface of the base plate before the $Al_2O_3$ passivation film is formed.

The surface of the base plate may be polished by mechanical polishing such as honing or lapping, buffing, or electrochemical polishing. In view of obtainable smoothness, electropolishing is most preferable.

(Electropolishing)

An exemplary electrolyte solution used in the electropolishing is an aqueous solution that contains 200 to 300 g/L of sulfuric acid, 650 to 700 g/L of phosphoric acid, or 50 to 100 g/L of chromic acid.

The electropolishing may be performed under conditions in which the temperature is 70 to 80° C., the current density is 15 to 20 A/dm$^2$, and the electropolishing time is 1 to 10 minutes.

The $Al_2O_3$-passivated bellows preferably have a maximum surface roughness $R_{max}$ of not more than 1 μm. In view of this, the electropolished base plate preferably has a maximum surface roughness $R_{max}$ of not more than 1 μm, more preferably not more than 0.5 μm, and particularly preferably not more than 0.1 μm. The maximum surface roughness is measured with a contact profiler.

The electropolishing is preferably followed by precision cleaning and drying.

[Step II]

In the step II, the untreated bellows from the step I is heated at 750 to 895° C. in an atmosphere which contains water and hydrogen and in which the volume ratio of hydrogen to water ($H_2/H_2O$) is in the range of $2\times10^3$ to $1\times10^{12}$, and thereby an $Al_2O_3$ passivation film is formed on a surface of the untreated bellows.

In the bellows production process, Al in the untreated bellows is preferentially oxidized over other easily oxidizable metals, and forms an $Al_2O_3$ passivation film on the bellows surface.

In the step II, the $Al_2O_3$ passivation film is formed on the entire bellows surface including welded and non-welded parts. Accordingly, it is not necessary that the flat base plate or the annular plate members are heated before the welding to form an $Al_2O_3$ passivation film.

(Heating Temperature)

In the step II, the heating temperature is 750 to 895° C., preferably 800 to 895° C., and more preferably 800 to 850° C.

If the heating temperature exceeds the above range, the $Al_2O_3$ passivation film becomes thick and has a rough surface (non-smoothness) or cracks. Further, other elements such as Fe are oxidized at excessively high temperatures and the proportion of Fe oxide increases in the $Al_2O_3$ passivation film, and the bellows will not achieve good corrosion resistance.

If the heating temperature is below the above range, Al in the base plate is not sufficiently oxidized and the bellows will not achieve high corrosion resistance. Further, composite oxide films such as Cr oxide film and Al oxide film tend to be formed. Furthermore, the heating time is increased and the bellows productivity is lowered.

(Heating Time)

In the step II, the heating time is generally 1 to 3 hours, and preferably 1 to 2 hours.

If the heating time exceeds the above range, the $Al_2O_3$ passivation film tends to become thick and have a rough surface (non-smoothness) or cracks. Further, other elements such as Fe are oxidized and the proportion of Fe oxide increases in the $Al_2O_3$ passivation film, and the bellows will not achieve good corrosion resistance. Furthermore, such long heating time will lower the bellows productivity.

If the heating time is below the above range, Al is not sufficiently oxidized and the bellows will not achieve high corrosion resistance.

(Atmosphere)

Heating the untreated bellows is carried out in an atmosphere which contains water and hydrogen and in which the volume ratio of hydrogen to water ($H_2/H_2O$) is in the range of $2\times10^3$ to $1\times10^2$, preferably $1\times10^5$ to $1\times10^9$, and more preferably $1\times10^5$ to $1\times10^6$. Usually, the atmosphere further contains an inert gas, that is, the atmosphere contains water, hydrogen and an inert gas.

When the untreated bellows is heat treated in an atmosphere containing water, hydrogen and an inert gas, the atmosphere generally contains water and hydrogen in total at 0.001 to 100% by volume, preferably 1 to 20% by volume, more preferably 1 to 10% by volume, and an inert gas at generally 0 to 99.999% by volume, preferably 80 to 99% by volume, more preferably 90 to 99% by volume.

If the hydrogen to water ratio exceeds the above range, the oxidation potential on the surface of the untreated bellows becomes excessively small. Consequently, Al is reduced and an $Al_2O_3$ passivation film is not sufficiently formed.

If the hydrogen to water ratio is below the above range, Cr and Fe in addition to Al are oxidized, and the obtainable $Al_2O_3$ passivation film becomes porous containing Cr and Fe.

The inert gases include nitrogen gas, Ar gas and He gas, with Ar gas being preferred in view of prevention of nitridation on the bellows surface and production costs.

The pressure in the heat treatment for the untreated bellows is generally 1 to 760 Torr, and preferably 50 to 300 Torr.

Raising the pressure above this range entails more gas and adds production costs.

If the pressure is below the above range, heat transfer coefficient is lowered and heat is not sufficiently transferred to the untreated bellows. Consequently, an increased heating time is required to obtain a predetermined thickness and bellows productivity is lowered.

(Film Thickness)

In the step II, the $Al_2O_3$ passivation film formed on the surface of the untreated bellows generally has a thickness of 20 to 150 nm, and preferably 50 to 100 nm.

If the thickness of the $Al_2O_3$ passivation film exceeds the above range, intermetallic compounds may be precipitated or the $Al_2O_3$ passivation film may be cracked. Further, such a thick $Al_2O_3$ passivation film has a larger residual stress and tends to be cracked or separated, failing to provide sufficient corrosion resistance.

If the thickness is less than the above range, the $Al_2O_3$ passivation film tends to fail to provide sufficient corrosion resistance.

The film thickness is preferably controlled by changing the heating time while maintaining the hydrogen to water volume ratio ($H_2/H_2O$) and the heating temperature constant.

(Composition of $Al_2O_3$ Passivation Film)

The $Al_2O_3$ passivation film formed in the step II generally contains main component $Al_2O_3$ at 98 to 100 wt %, and preferably 99 to 100 wt %. It may contain other components while still achieving the object of the invention.

Such other components include Fe oxide, Cr oxide and Ni oxide.

The composition of the $Al_2O_3$ passivation film is preferably controlled by changing the hydrogen to water volume ratio ($H_2/H_2O$) while maintaining the heating temperature and the heating time constant.

[Bellows]

The bellows produced by the method of the invention have the $Al_2O_3$ passivation film of excellent corrosion and plasma resistance on the entire surface including welded parts. It is generally known that $Al_2O_3$ passivation films possess high corrosion resistance and plasma resistance.

Accordingly, the bellows produced by the method of the invention have excellent resistance to corrosive gases or active gases such as plasma, ozone and oxygen radicals, and can prevent corrosion or metallic contamination even when used in semiconductor manufacturing devices. The passivation film formed according to the present invention does not contain elements such as fluorine that have a catalytic action of facilitating the decomposition of special material gases such as $SiH_4$and $PH_3$ used in semiconductor manufacturing. Therefore, the bellows having this passivation film may be used as vertically-extendable bellows attached to a wafer mounting stage in a process chamber of a semiconductor manufacturing device.

Because of high mechanical properties of the base plate having the aforementioned chemical composition, for example Al-containing stainless steel HR31 (austenitic stainless steel manufactured by Sumitomo Metal Industries, Ltd.), extended mechanical life such as an increased number of extension and contraction over conventional bellows may be achieved. The bellows of the invention have corrosion resistance and plasma resistance as well as excellent mechanical properties.

EXAMPLES

The present invention will be described in greater detail hereinbelow by presenting Examples without limiting the scope of the invention.

(X-Ray Photoelectron Spectroscopy for Base Plate)

The base plate was etched in the depth direction with argon ion, and the chemical composition of the base plate was analyzed at several depths by means of XPS (X-ray photoelectron spectrometer manufactured by JEOL Ltd.).

(Ozone Resistance Test 1)

Ozone resistance 1 was tested by soaking the bellows for 5 days in ultrapure water which contained 10 ppm by weight of $O_3$ and which flowed at 50 cc/min. Ozone resistance 1 was evaluated by analyzing the chemical composition of the $Al_2O_3$ passivation film by XPS and by observing the bellows surface with SEM (scanning electron microscope manufactured by JEOL Ltd.).

(Ozone Resistance Test 2)

Ozone resistance 2 was tested by exposing the bellows for 24 hours to an $O_2$ atmosphere at 100° C. which contained 10% by volume of $O_3$ and which flowed at 1 L/min. Ozone resistance 2 was evaluated to be very good, good or bad based on the observation of the bellows surface with SEM (scanning electron microscope manufactured by JEOL Ltd.).

(Ultrapure Water Resistance Test)

Ultrapure water resistance was tested by soaking the bellows in ultrapure water at 25° C. for 5 days. Ultrapure water resistance was evaluated by analyzing the chemical composition of the $Al_2O_3$ passivation film by XPS and by observing the bellows surface with SEN (scanning electron microscope manufactured by JEOL Ltd.).

(Durability Test)

Extension/contraction test and particle test were carried out to test durability of the bellows.

Extension/Contraction Test:

The bellows was extended to a 2 to 3-fold length and contracted (hereinafter referred to as extension/contraction) 10,000,000 times, and any damage on the bellows was visually inspected for.

Particle Test:

The inside of the bellows was controlled at atmospheric pressure, and the bellows was subjected to 1,000,000 cycles of extension/contraction. After every 100,000 cycles of extension/contraction, the number of particles (particle diameter: 0.1 μm or more) generated per 100 cycles was counted with an airborne particle counter (manufactured by RION Co., Ltd.).

Example 1

<Step I>

(Flat Base Plate)

The flat base plate was Al-containing stainless steel HR31 (austenitic stainless steel manufactured by Sumitomo Metal Industries, Ltd., thickness: 0.12 mm) that contained 17.7 wt % of Cr, 25.5 wt % of Ni, 3.0 wt % of Al, 0.01 wt % of Mo, less than 0.01 wt % of Mn, less than 0.01 wt % of C, less than 0.01 wt % of S, less than 0.01 wt % of P and a balance of Fe and an unavoidable impurity (relative to 100 wt % of the base plate).

FIG. 1 shows results of XPS measurement of the flat base plate. As shown in FIG. 1, oxide layers such as of Al and Fe were present in a region ranging from the surface (0 nm) to a depth of about 100 nm.

(Electropolishing)

Figure 2:
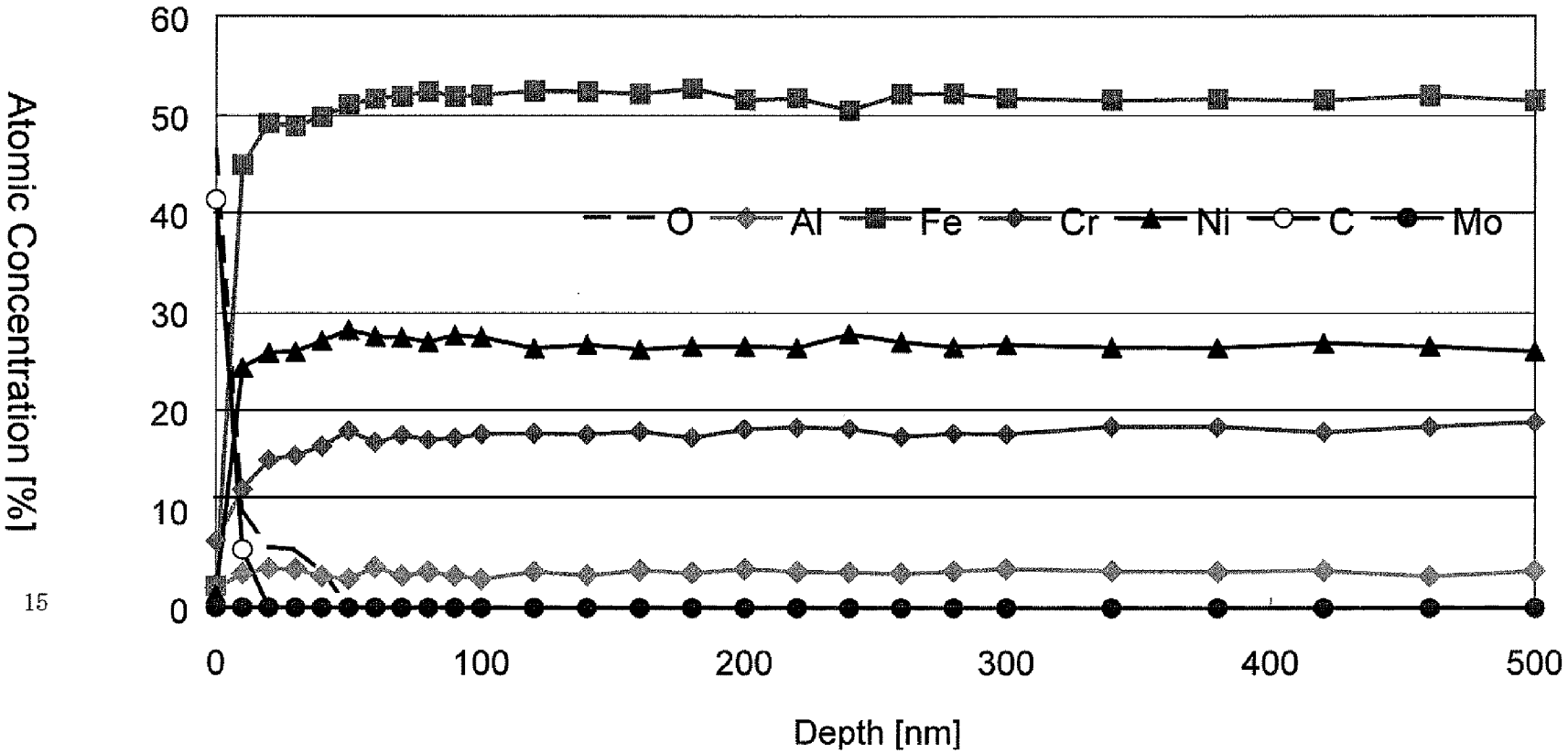
FIG. 2 shows results of XPS measurement of an electropolished flat base plate used in Example 1.

To remove the above oxide layers, the surface of the flat base plate was electropolished. FIG. 2 shows results of XPS measurement of the electropolished flat base plate. As shown in FIG. 2, the oxide layers such as of Al and Fe were removed from the plate surface by electropolishing.

(Production of Untreated Bellows)

Figure 3:
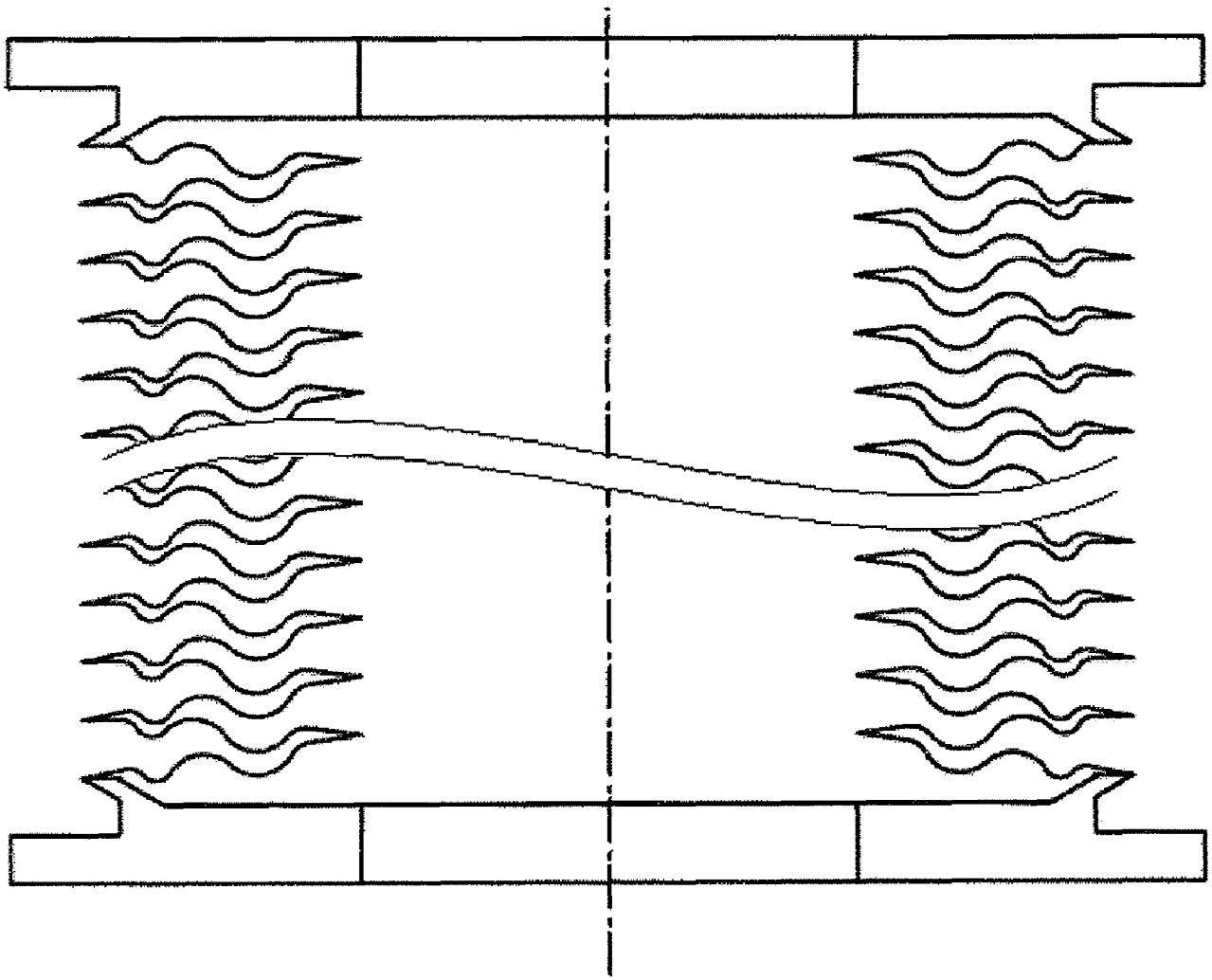
FIG. 3 is a schematic view showing an untreated bellows prepared in Example 1.

120 sheets of annular plate members were punched out from the electropolished flat base plate so that waves were formed concentrically on the annular plate members. The annular plate members were welded to give an untreated bellows having an inner diameter of 71.42 mm, an outer diameter of 84.12 mm and 60 mountains. (FIG. 3 shows a schematic view of the untreated bellows prepared in Example 1.)

<Step II>

The untreated bellows from the step I was heated under the following conditions to form an $Al_2O_3$ passivation film on the untreated bellows.

Heating temperature: 850° C.

Heating time: 2 hours

Pressure: 150 Torr

Atmosphere: Ar atmosphere which contained $H_2O$ and $H_2$ at 10% by volume in total and in which the hydrogen to water volume ratio ($H_2/H_2O$) was $1.0\times10^5$.

Flow rate: 20 L/min

Figure 4:
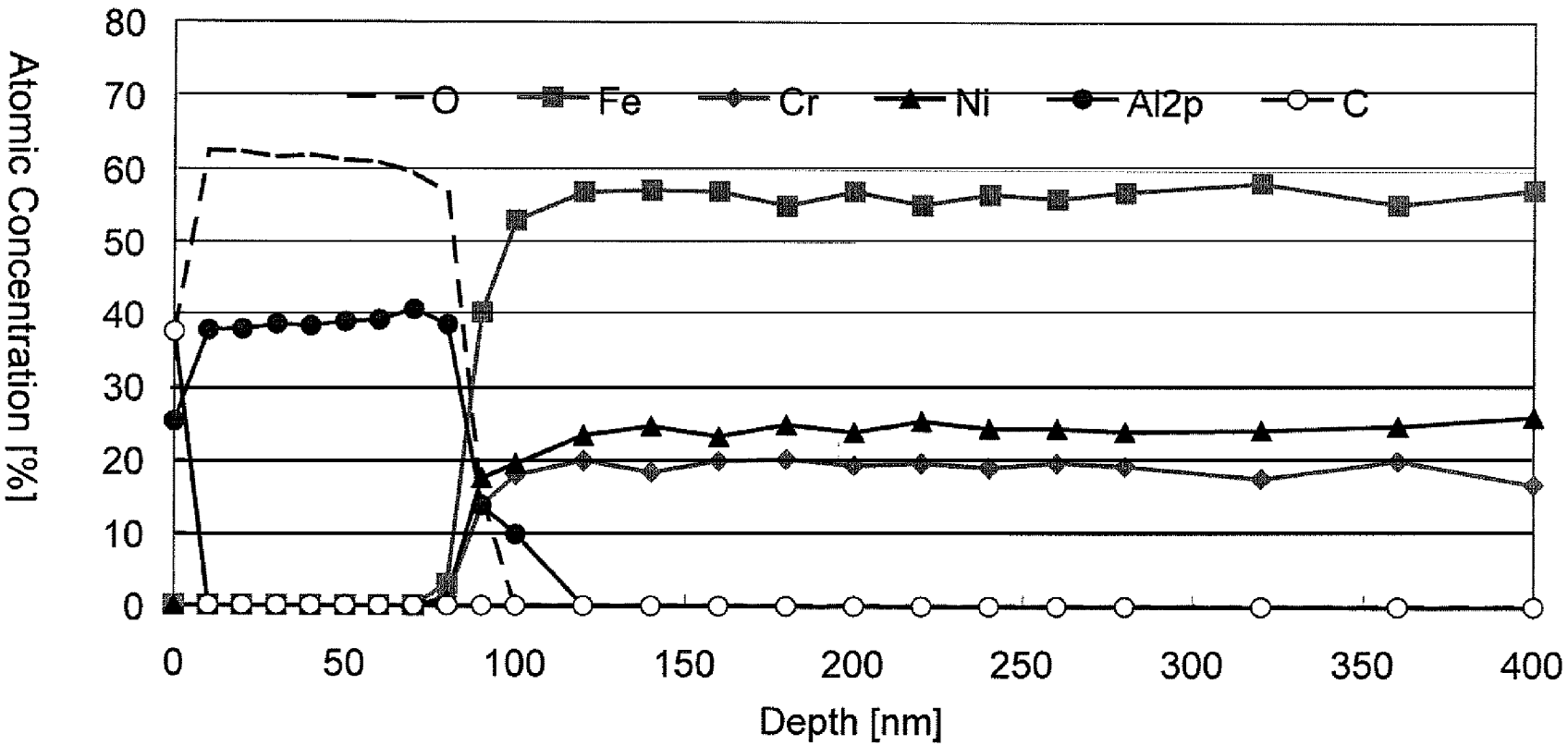
FIG. 4 shows results of XPS measurement of a wave portion of a heat treated bellows used in Example 1.
Figure 5:
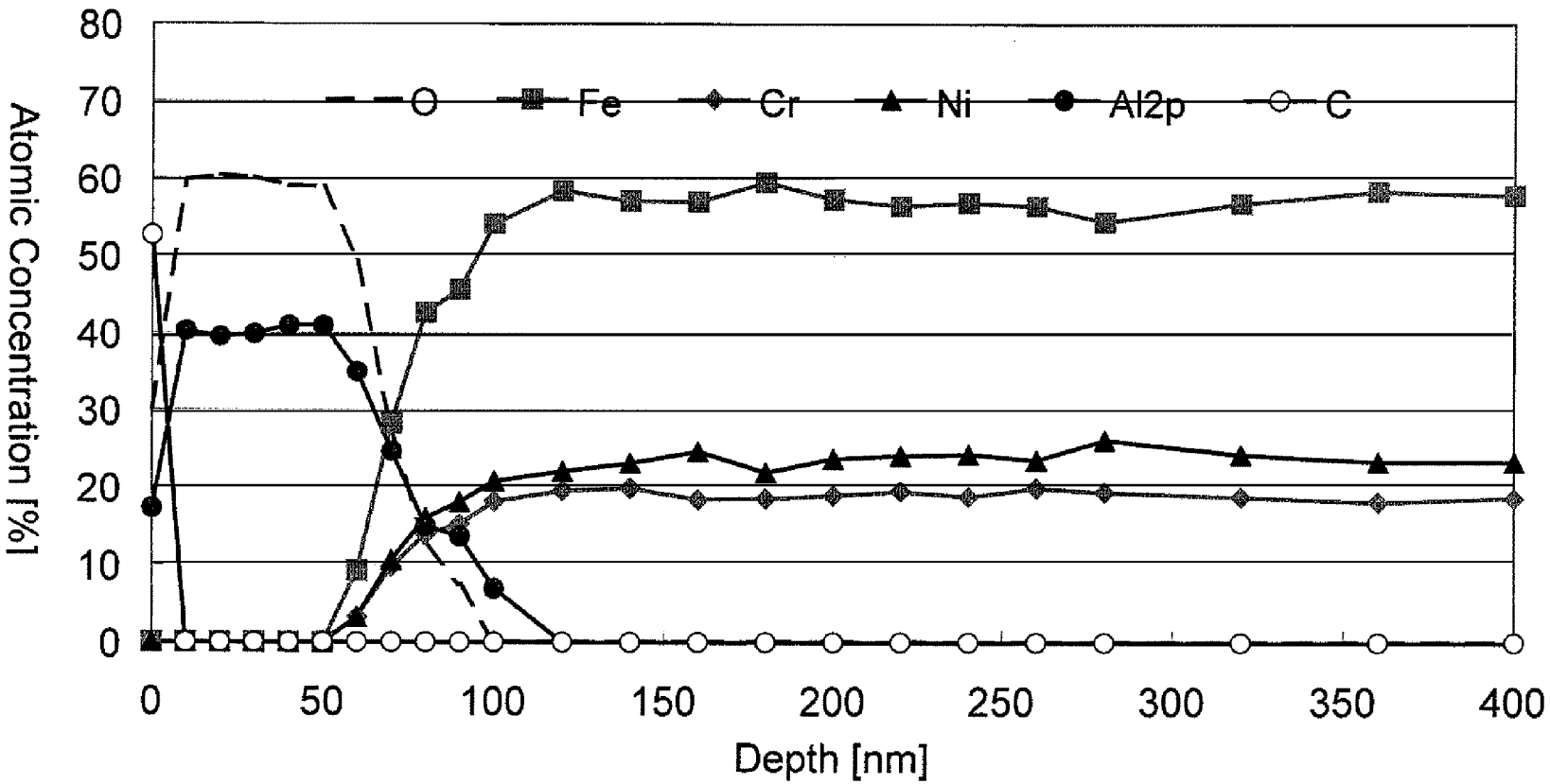
FIG. 5 shows results of XPS measurement of a welded part of the heat treated bellows used in Example 1.

FIG. 4 shows results of XPS measurement of a concentric wave portion (hereinafter the wave portion) of the heat treated bellows, and FIG. 5 shows results of XPS measurement of a welded part of the heat treated bellows. As shown in FIG. 4, the $Al_2O_3$ passivation film was formed from the surface (0 nm) to a depth of 80 nm of the wave portion of the bellows. Further, as shown in FIG. 5, the $Al_2O_3$ passivation film was formed from the surface (0 nm) to a depth of 50 nm of the welded portion of the bellows. The $Al_2O_3$ passivation film was found to contain 99.9 wt % of $Al_2O_3$.

<Ozone Resistance 1 and Ultrapure Water Resistance>

The $Al_2O_3$-passivated bellows was tested for ozone resistance 1 and ultrapure water resistance.

The chemical composition and surface state of the $Al_2O_3$ passivation film did not substantially change before and after the ozone resistance test 1 and ultrapure water resistance test. It was then demonstrated that the bellows produced by the method of the invention had superior resistance to highly oxidative ozone and ultrapure water.

<Durability Test>

The extension/contraction test did not cause any damage on the bellows.

In the particle test, the number of particles was 2 or less particles per 100 extension/contraction cycles until the completion of 1,000,000 cycles.

<Ozone Resistance 2>

Table 1 sets forth the results of ozone resistance test 2 for the $Al_2O_3$-passivated bellows.

Example 2

A bellows was produced in the same manner as in Example 1, except that the heating time in the step II was changed to 1 hour.

Figure 6:
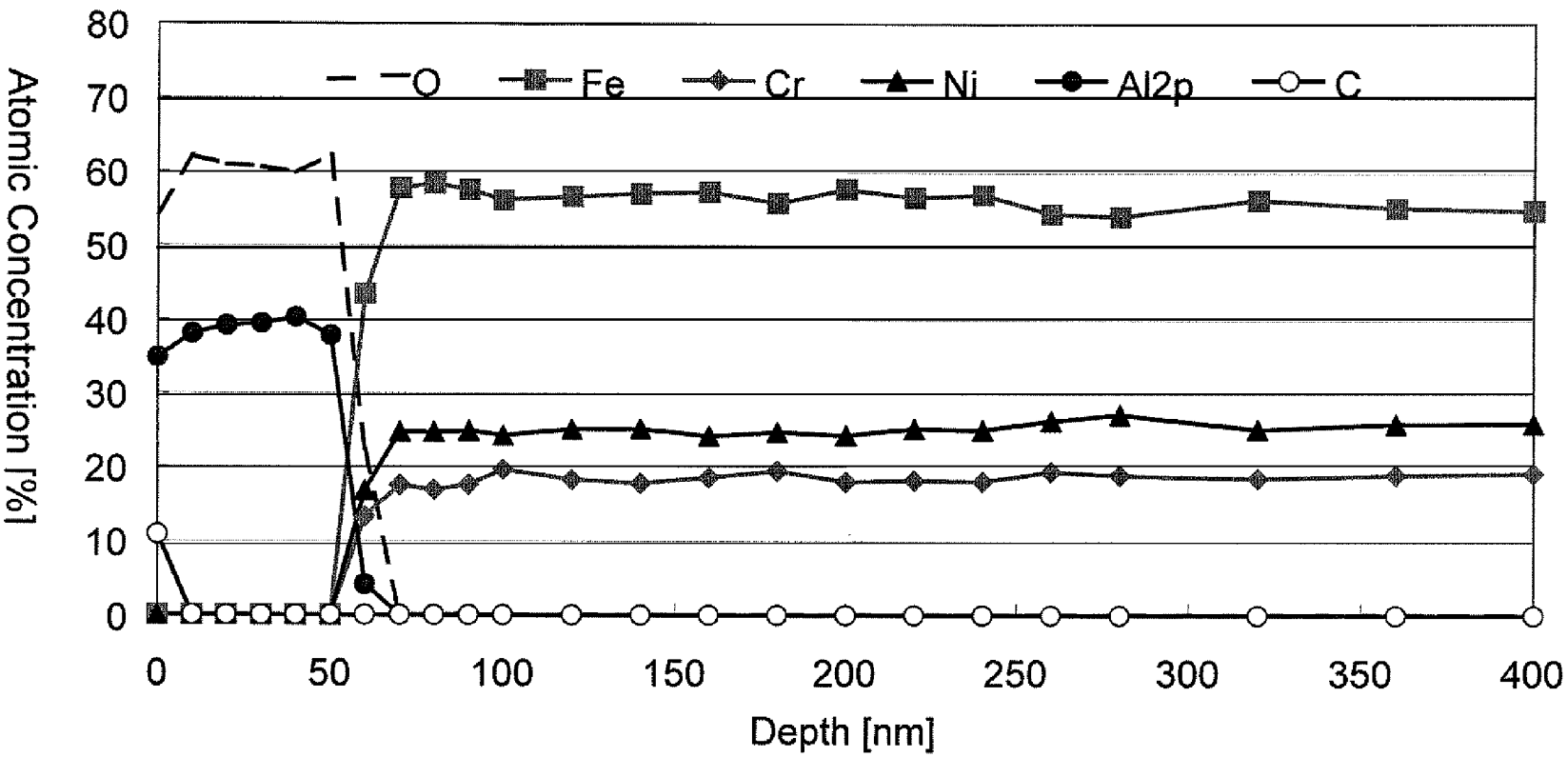
FIG. 6 shows results of XPS measurement of a wave portion of a heat treated bellows used in Example 2.

FIG. 6 shows results of XPS measurement of a wave portion of the heat treated bellows. As shown in FIG. 6, the $Al_2O_3$ passivation film was formed from the surface (0 nm) to a depth of 50 nm of the wave portion of the bellows. The $Al_2O_3$ passivation film formed with a heating time of 1 hour had a smaller thickness (FIG. 6) than the thickness (FIG. 4) of the $Al_2O_3$ passivation film formed with a heating time of 2 hours. This result shows that the thickness of the $Al_2O_3$ passivation film is controlled by the heating time. The $Al_2O_3$ passivation film in Example 2 was found to contain 99.9 wt % of $Al_2O_3$.

<Ozone Resistance 1 and Ultrapure Water Resistance>

The $Al_2O_3$-passivated bellows was tested for ozone resistance 1 and ultrapure water resistance.

The chemical composition and surface state of the $Al_2O_3$ passivation film did not substantially change before and after the ozone resistance test 1 and ultrapure water resistance test.

The $Al_2O_3$ passivation film of the bellows was analyzed by XPS to determine the chemical composition of the $Al_2O_3$ passivation film, resulting in an $Al_2O_3$ content of 95 wt % and a $Cr_2O_3$ content of 5 wt %.

<Ozone Resistance 2>

Table 1 sets forth the results of ozone resistance test 2 for the $Al_2O_3$-passivated bellows.

Comparative Example 2

A bellows was produced in the same manner as in Example 1, except that the atmosphere in the step II was changed to an Ar atmosphere which contained $H_2O$ and $H_2$ at 10% by volume in total and in which the hydrogen to water volume ratio ($H_2/H_2O$) was $5\times10^2$.

The $Al_2O_3$ passivation film of the bellows was analyzed by XPS to determine the chemical composition of the $Al_2O_3$ passivation film, resulting in an $Al_2O_3$ content of 90 wt % and a $Cr_2O_3$ content of 10 wt %.

<Ozone Resistance 2>

Table 1 sets forth the results of ozone resistance test 2 for the $Al_2O_3$-passivated bellows.

The results indicate that the $Al_2O_3$ content in the $Al_2O_3$ passivation film of the bellows is controlled by changing the atmosphere (hydrogen to water volume ratio) in the heat treatment in the step II.

TABLE 1

| | Ex. 1 | Ex. 3 | Comp. Ex. 1 | Comp. Ex. 2 |
|---|---|---|---|---|
| $H_2/H_2O$ volume ratio | $1\times10^5$ | $2\times10^3$ | $1\times10^3$ | $5\times10^2$ |
| $Al_2O_3$ content (wt %) | 100* | 98* (Remaining 2 wt %: $Cr_2O_3$) | 95* (Remaining 5 wt %: $Cr_2O_3$) | 90* (Remaining 10 wt %: $Cr_2O_3$) |
| Surface state | Very good | Good | Bad | Bad |

*: $Al_2O_3$ content was rounded off to the nearest integer.

It was then demonstrated that the bellows produced by the method of the invention had superior resistance to highly oxidative ozone and ultrapure water.

<Durability Test>

The extension/contraction test did not cause any damage on the bellows.

In the particle test, the number of particles was 2 or less particles per 100 extension/contraction cycles until the completion of 1,000,000 cycles.

Example 3

A bellows was produced in the same manner as in Example 1, except that the atmosphere in the step II was changed to an Ar atmosphere which contained $H_2O$ and $H_2$ at 10% by volume in total and in which the hydrogen to water volume ratio ($H_2/H_2O$) was $2\times10^3$.

The $Al_2O_3$ passivation film of the bellows was analyzed by XPS to determine the chemical composition of the $Al_2O_3$ passivation film, resulting in an $Al_2O_3$ content of 98 wt % and a $Cr_2O_3$ content of 2 wt %.

<Ozone Resistance 2>

Table 1 sets forth the results of ozone resistance test 2 for the $Al_2O_3$-passivated bellows.

Comparative Example 1

A bellows was produced in the same manner as in Example 1, except that the atmosphere in the step II was changed to an Ar atmosphere which contained $H_2O$ and $H_2$ at 10% by volume in total and in which the hydrogen to water volume ratio ($H_2/H_2O$) was $1\times10^3$.

What is claimed is:

1. A method for manufacturing bellows, comprising the steps of:

I: forming an untreated bellows from a flat base plate, the base plate comprising 15 to 30 wt % of Cr, 5 to 40 wt % of Ni, 0.9 to 6 wt % of Al, less than 1 wt % of Mo, less than 0.1 wt % of Mn, less than 0.1 wt % of C, less than 0.1 wt % of S, less than 0.1 wt % of P and a balance of Fe and an unavoidable impurity relative to 100 wt % of the base plate; and II: heating the untreated bellows at a temperature within a range of 750 to 895° C. in an atmosphere which contains water and hydrogen and in which the volume ratio of hydrogen to water ($H_2/H_2O$) is in the range of $2\times10^3$ to $1\times10^{12}$, thereby forming an $Al_2O_3$ passivation film on a surface of the untreated bellows.

2. The method according to claim 1, wherein the atmosphere in the step of II contains water and hydrogen in total at 0.001 to 100% by volume, and an inert gas at 99.999 to 0% by volume.

3. The method according to claim 1, wherein the step I comprises:

a first step in which at least four annular plate members each having an outer peripheral rim and an inner peripheral rim are punched out from a flat base plate, the base plate comprising 15 to 30 wt % of Cr, 5 to 40 wt % of Ni, 0.9 to 6 wt % of Al, less than 1 wt % of Mo, less than 0.1 wt % of Mn, less than 0.1 wt % of C, less than 0.1 wt % of S, less than 0.1 wt % of P and a balance of Fe and an unavoidable impurity relative to 100 wt % of the base plate;

a second step in which each pair of the annular plate members is stacked and joined together by welding the inner peripheral rims to produce a plurality of welded members; and a third step in which the plurality of the welded members are stacked and joined together by welding the outer peripheral rims to form an untreated bellows.

4. The method according to claim 1, wherein the flat base plate is an electropolished flat base plate.

5. The method according to claim 3, further comprising a step of electropolishing surfaces of the annular plate members between the first step and the second step.

6. The method according to claim 1, wherein the $Al_2O_3$ passivation film has a thickness of 20 to 150 nm.

7. The method according to claim 1, wherein the $Al_2O_3$ passivation film contains $Al_2O_3$ at 98 to 100 wt %.

8. The method according to claim 2, wherein the step I comprises:

a first step in which at least four annular plate members each having an outer peripheral rim and an inner peripheral rim are punched out from a flat base plate, the base plate comprising 15 to 30 wt % of Cr, 5 to 40 wt % of Ni, 0.9 to 6 wt % of Al, less than 1 wt % of Mo, less than 0.1 wt % of Mn, less than 0.1 wt % of C, less than 0.1 wt % of S, less than 0.1 wt % of P and a balance of Fe and an unavoidable impurity relative to 100 wt % of the base plate;

a second step in which each pair of the annular plate members is stacked and joined together by welding the inner peripheral rims to produce a plurality of welded members; and a third step in which the plurality of the welded members are stacked and joined together by welding the outer peripheral rims to form an untreated bellows.

9. The method according to claim 2, wherein the flat base plate is an electropolished flat base plate.

10. The method according to claim 2, wherein the $Al_2O_3$ passivation film has a thickness of 20 to 150 nm.

11. The method according to claim 2, wherein the $Al_2O_3$ passivation film contains $Al_2O_3$ at 98 to 100 wt %.

12. A bellows obtained by:

forming an untreated bellows from a flat base plate, the base plate comprising 15 to 30 wt % of Cr, 5 to 40 wt % of Ni, 0.9 to 6 wt % of Al, less than 1 wt % of Mo, less than 0.1 wt % of Mn, less than 0.1 wt % of C, less than 0.1 wt % of S, less than 0.1 wt % of P and a balance of Fe and an unavoidable impurity relative to 100 wt % of the base plate; and heating the untreated bellows at a temperature within a range of 750 to 895° C. in an atmosphere which contains water and hydrogen and in which the volume ratio of hydrogen to water ($H_2/H_2O$) is in the range of $2\times10^3$ to $1\times10^{12}$, thereby forming an $Al_2O_3$ passivation film on a surface of the untreated bellows.

13. The bellows according to claim 12, wherein the atmosphere contains water and hydrogen in total at 0.001 to 100% by volume, and an inert gas at 99.999 to 0% by volume.

14. The bellows according to claim 13, wherein the $Al_2O_3$ passivation film has a thickness of 20 to 150 nm.

15. The bellows according to claim 13, wherein the $Al_2O_3$ passivation film contains $Al_2O_3$ at 98 to 100 wt %.

16. The bellows according to claim 12, wherein the $Al_2O_3$ passivation film has a thickness of 20 to 150 nm.

17. The bellows according to claim 12, wherein the $Al_2O_3$ passivation film contains $Al_2O_3$ at 98 to 100 wt %.

* * * * *